US011489245B2

(12) United States Patent
Freebury et al.

(10) Patent No.: US 11,489,245 B2
(45) Date of Patent: Nov. 1, 2022

(54) ANTENNA SYSTEM WITH DEPLOYABLE AND ADJUSTABLE REFLECTOR

(71) Applicant: TENDEG LLC, Louisville, CO (US)

(72) Inventors: Gregg E. Freebury, Louisville, CO (US); Matthew Phillip Mitchell, Colorado Springs, CO (US)

(73) Assignee: TENDEG LLC, Louisville, CO (US)

( * ) Notice: Subject to any disclaimer, the term of this patent is extended or adjusted under 35 U.S.C. 154(b) by 0 days.

(21) Appl. No.: 16/723,627

(22) Filed: Dec. 20, 2019

(65) Prior Publication Data

US 2020/0203798 A1 Jun. 25, 2020

Related U.S. Application Data

(60) Provisional application No. 62/782,599, filed on Dec. 20, 2018.

(51) Int. Cl.
*H01Q 1/08* (2006.01)
*H01Q 15/16* (2006.01)
*H01Q 1/28* (2006.01)

(52) U.S. Cl.
CPC ..... *H01Q 1/08* (2013.01); *H01Q 1/288* (2013.01); *H01Q 15/161* (2013.01)

(58) Field of Classification Search
CPC ..... H01Q 3/02; H01Q 3/08; H01Q 1/125; H01Q 1/288; H01Q 15/161; H01Q 15/16
See application file for complete search history.

(56) References Cited

U.S. PATENT DOCUMENTS 4,375,878 A 3/1983 Harvey et al.
4,613,870 A 9/1986 Stonier
5,673,057 A 9/1997 Toland et al.
5,680,145 A 10/1997 Thompson et al.
6,028,569 A 2/2000 Bassily et al.
6,285,339 B1 * 9/2001 McGill ..... F16M 11/10 248/278.1
8,161,832 B2 4/2012 Naumov et al.
9,310,479 B2 * 4/2016 Knight ..... H01Q 1/12
9,590,299 B2 3/2017 Rao et al.
9,608,333 B1 3/2017 Toledo et al.
9,813,151 B2 11/2017 Kingsbury et al.
10,131,452 B1 * 11/2018 Rohweller ..... H01Q 1/1235
10,170,843 B2 1/2019 Thompson et al.
2001/0028327 A1 10/2001 Yamamoto et al.
(Continued)

FOREIGN PATENT DOCUMENTS

EP 3408892 B1 12/2021

OTHER PUBLICATIONS

PCT International Patent Application No. PCT/US20/32023; International Search Report and Written Opinion of the International Searching Authority dated Aug. 6, 2020, 10 pages.
(Continued)

*Primary Examiner* — Andrea Lindgren Baltzell
*Assistant Examiner* — Yonchan J Kim
(74) *Attorney, Agent, or Firm* — Craig R. Miles; CR Miles P.C.

(57) ABSTRACT

A satellite including an antenna assembly adjustable between a stowed configuration and a deployed configuration. When in the stowed configuration, the antenna assembly can be stowable within a container, such as a container compatible with a CubeSat. When in the deployed configuration, a reflector of the antenna assembly can be directionally adjustable, such as in both elevation and azimuth.

20 Claims, 13 Drawing Sheets

(56) References Cited

U.S. PATENT DOCUMENTS

| | | | |
|---|---|---|---|
| 2005/0104798 | A1 | 5/2005 | Nolan et al. |
| 2010/0259458 | A1 | 10/2010 | Mattis et al. |
| 2012/0019430 | A1 | 1/2012 | Desagulier |
| 2014/0152492 | A1 | 6/2014 | Zimmerman et al. |
| 2014/0263844 | A1 | 9/2014 | Cook, Jr. et al. |
| 2015/0094104 | A1 | 4/2015 | Wilmhoff et al. |
| 2015/0288072 | A1 | 10/2015 | Medzmariashvili et al. |
| 2015/0303582 | A1 | 10/2015 | Meschini et al. |
| 2016/0072185 | A1 | 3/2016 | Lanciault et al. |
| 2016/0197394 | A1 | 7/2016 | Harvey et al. |
| 2016/0352022 | A1* | 12/2016 | Thomson ..... H01Q 1/288 |
| 2017/0025745 | A1 | 1/2017 | Clayton et al. |
| 2017/0222308 | A1 | 8/2017 | Freebury et al. |
| 2017/0294707 | A1 | 10/2017 | Gaudette et al. |

OTHER PUBLICATIONS

Moog Inc. Type 22 Antenna Pointing Assembly. Website, https://www.moog.com/content/dam/moog/literature/Space_Defense/spaceliterature/spacecraft_mechanisms/500-615_Type_22_APM.pdf, orginally downloaded Dec. 6, 2019, 2 pages.

National Aeronautics and Space Administration. CubeSat 101. Website, https://www.nasa.gov/sites/default/files/atoms/files/nasa_csli_cubesat_101_508.pdf, dated Oct. 2017, 96 pages.

PCT International Patent Application No. PCT/US19/68132, International Search Report and Written Opinion of the International Searching Authority dated May 20, 2020, 18 pages.

Canadian Patent Application No. 3,049,372, Office Action dated Jan. 21, 2022, 4 pages.

* cited by examiner

ANTENNA SYSTEM WITH DEPLOYABLE AND ADJUSTABLE REFLECTOR

This United States Non-Provisional Patent Application claims the benefit of U.S. Provisional Patent Application No. 62/782,599, filed Dec. 20, 2018, hereby incorporated by reference herein.

SUMMARY OF THE INVENTION

A particular embodiment of the invention can include a satellite, and methods of making and using such a satellite, whereby the satellite comprises an antenna assembly adjustable between a stowed configuration and a deployed configuration. When in the stowed configuration, the antenna assembly can be stowable within a container, such as a container compatible with a CubeSat. When in the deployed configuration, a reflector of the antenna assembly can be directionally adjustable, such as in both elevation and azimuth.

Naturally, further objects of the invention are disclosed throughout other areas of the specification, drawings, and claims.

A BRIEF DESCRIPTION OF THE DRAWINGS

FIG. 13 is a second side view of the particular embodiment of the satellite shown in

FIG. 9.

Figure 9:
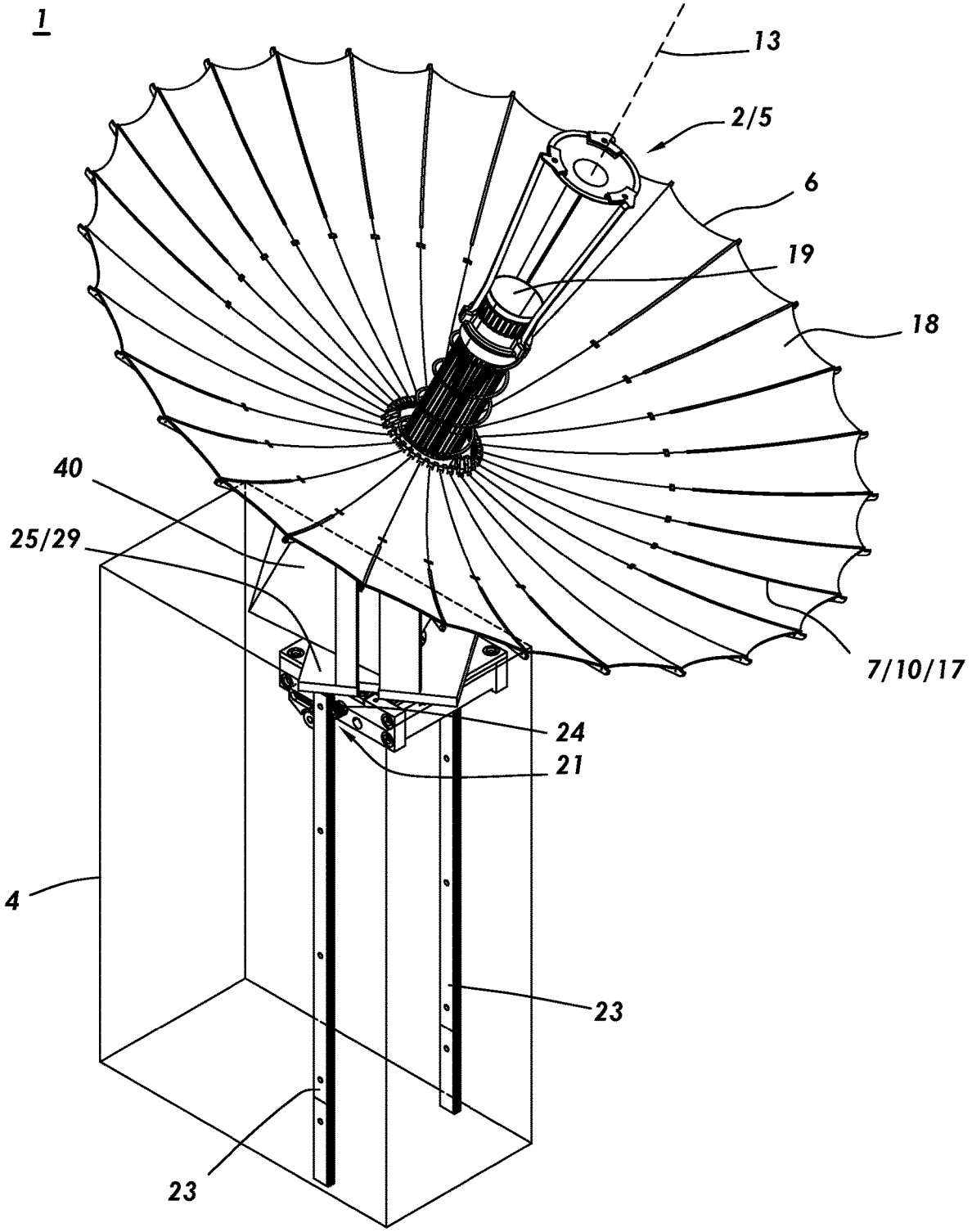
FIG. 9 is a perspective view of an embodiment of the instant satellite including an antenna assembly, whereby the antenna assembly is disposed in a deployed configuration.
Figure 11:
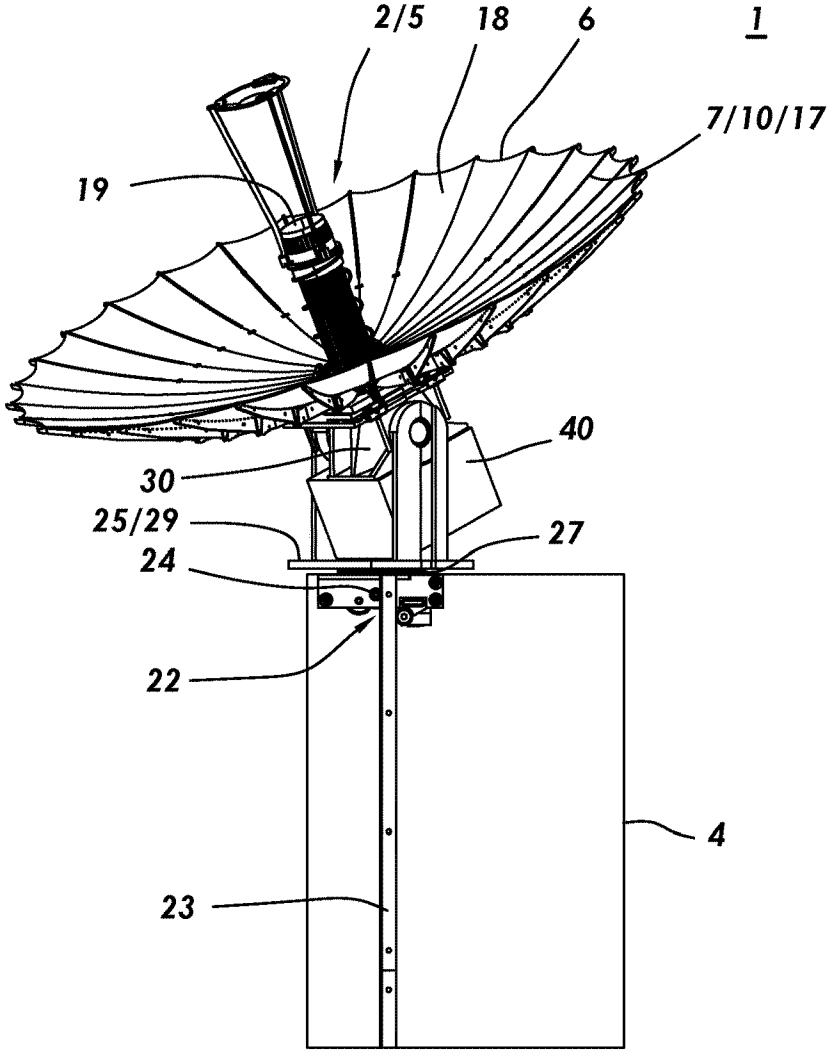
FIG. 11 is a rear view of the particular embodiment of the satellite shown in FIG. 9.
Figure 10:
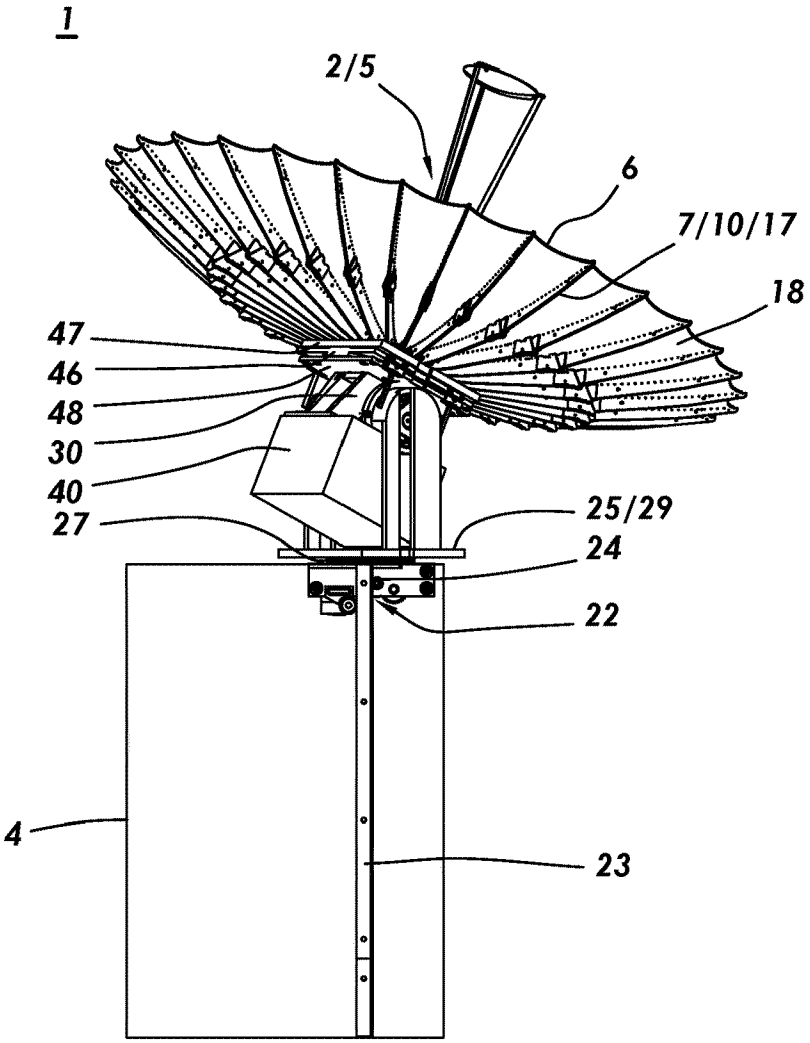
FIG. 10 is a front view of the particular embodiment of the satellite shown in FIG. 9.
Figure 13:
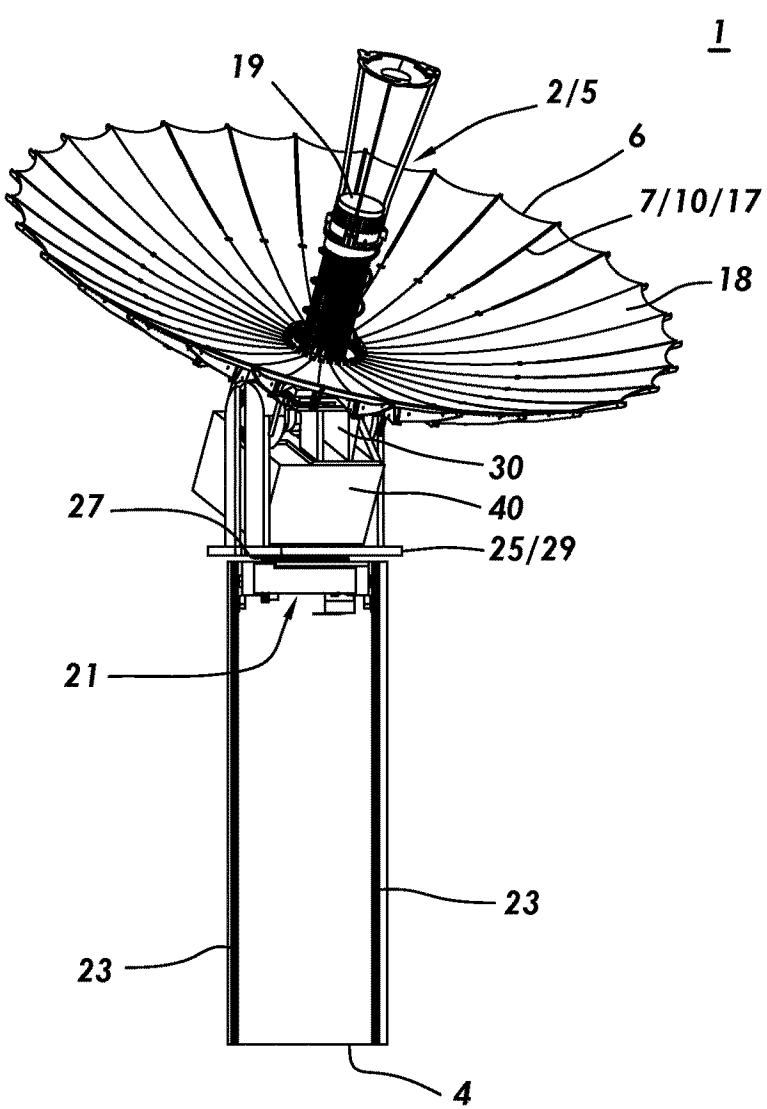
Figure 12:
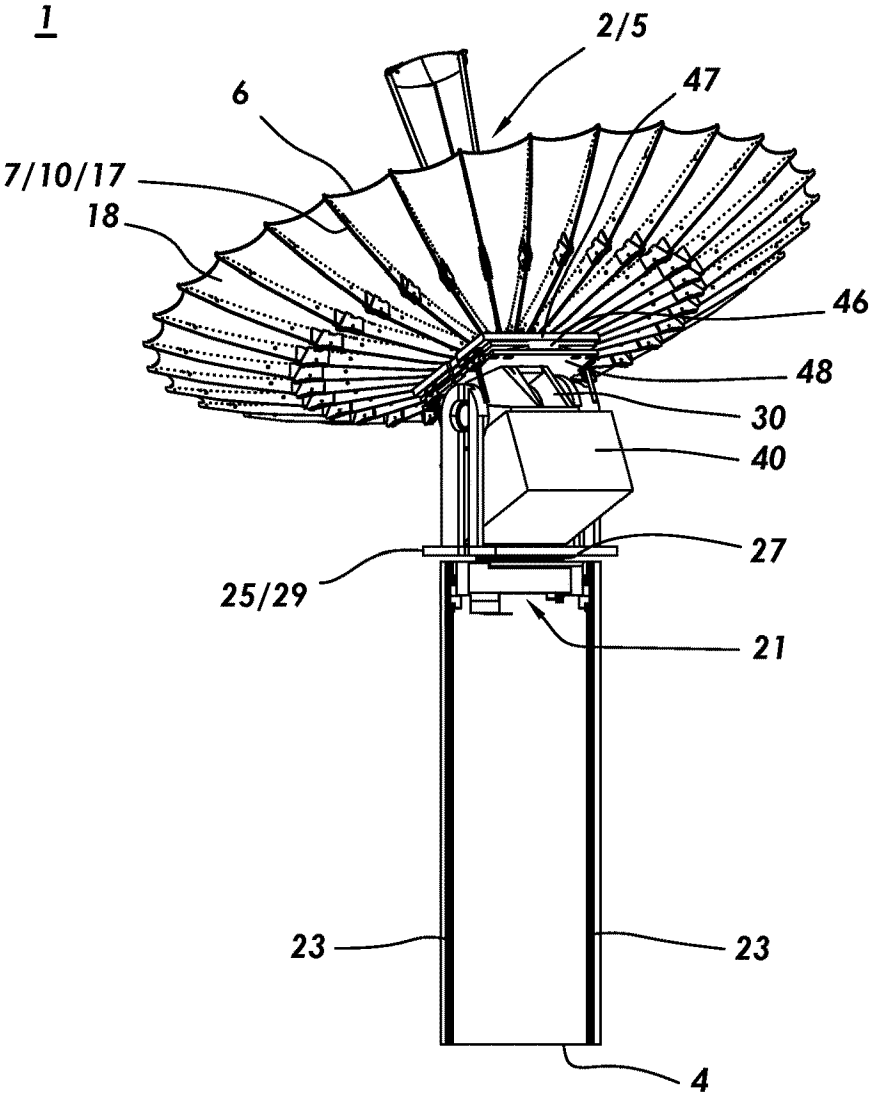
FIG. 12 is a first side view of the particular embodiment of the satellite shown in FIG. 9.
Figure 14:
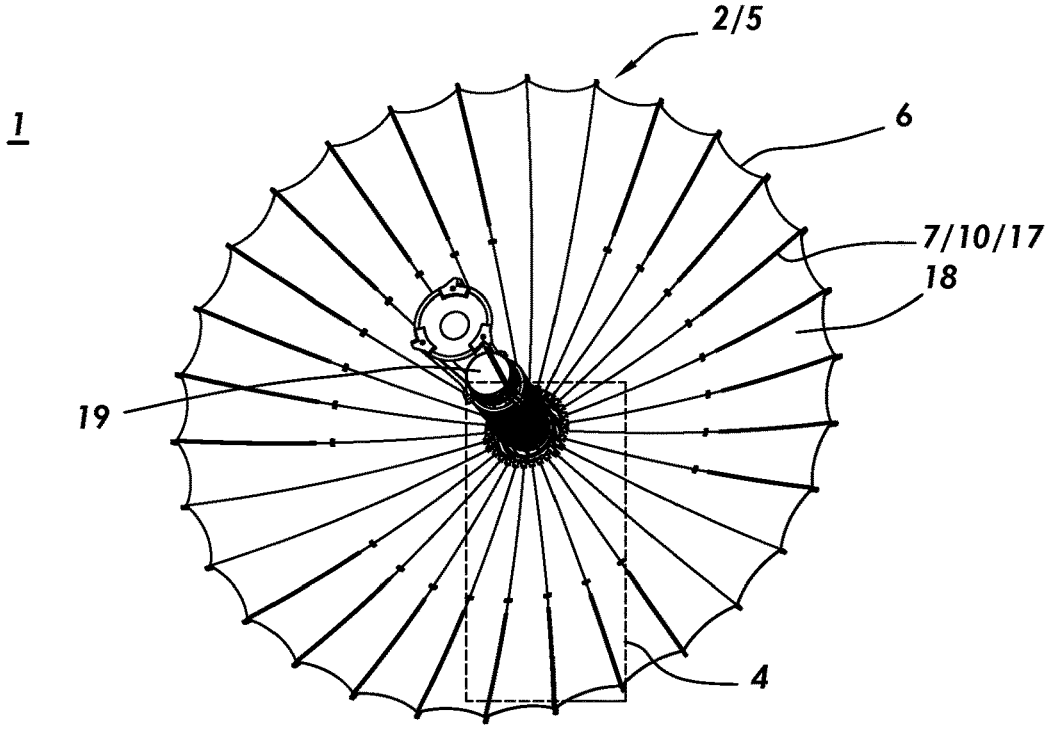

FIG. 14 is a top view of the particular embodiment of the satellite shown in FIG. 9.

Figure 15:
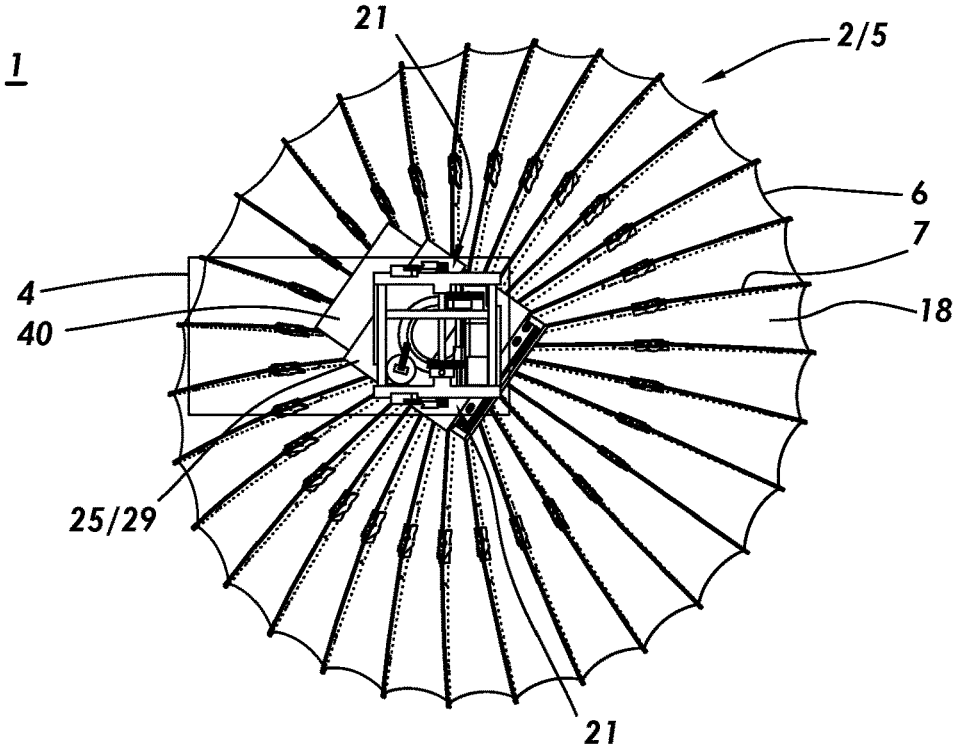

FIG. 15 is a bottom view of the particular embodiment of the satellite shown in FIG. 9.

Figure 16A:
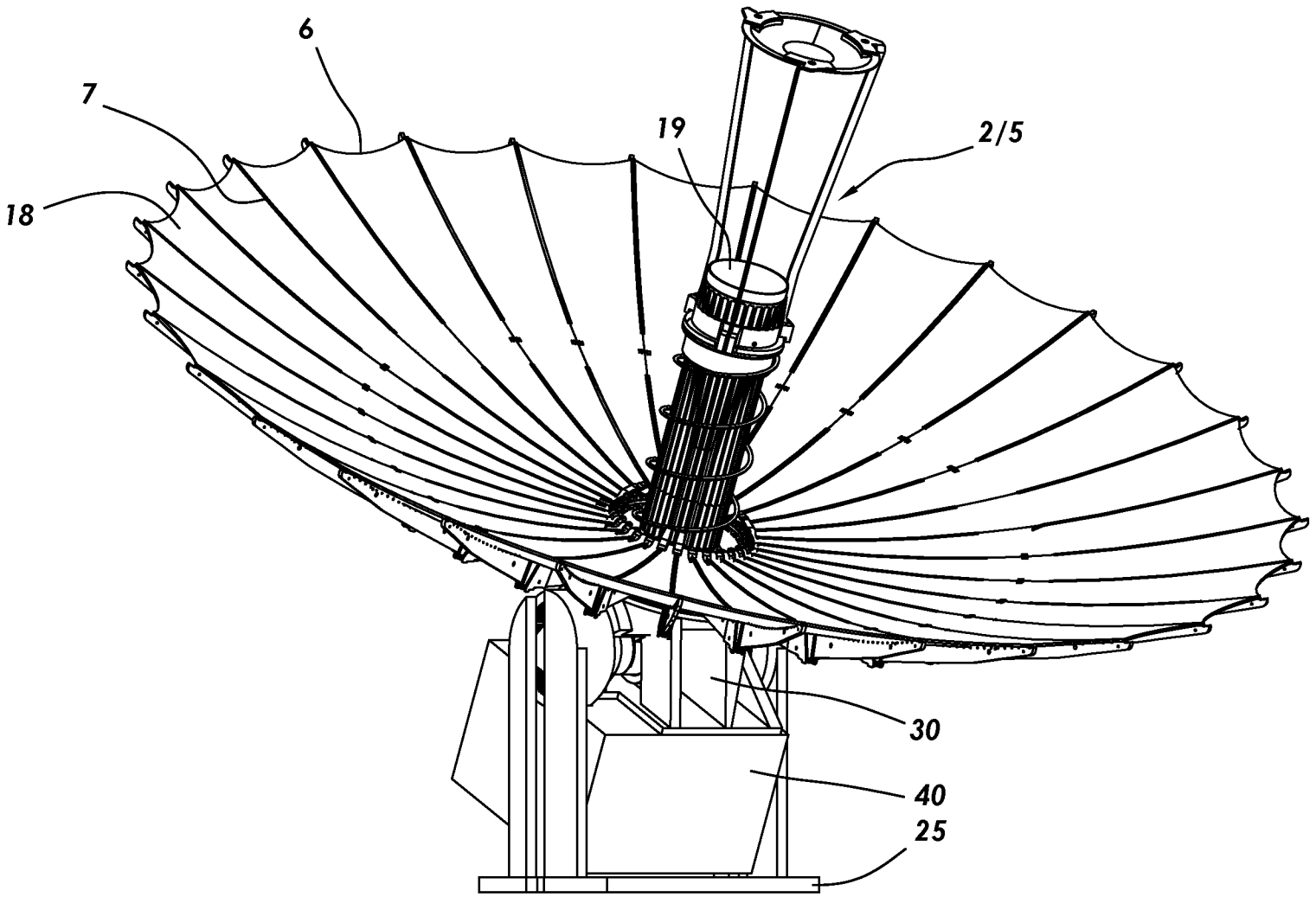

FIG. 16A is an enlarged perspective view of a particular embodiment of a first gimbal of the instant satellite.

Figure 16B:
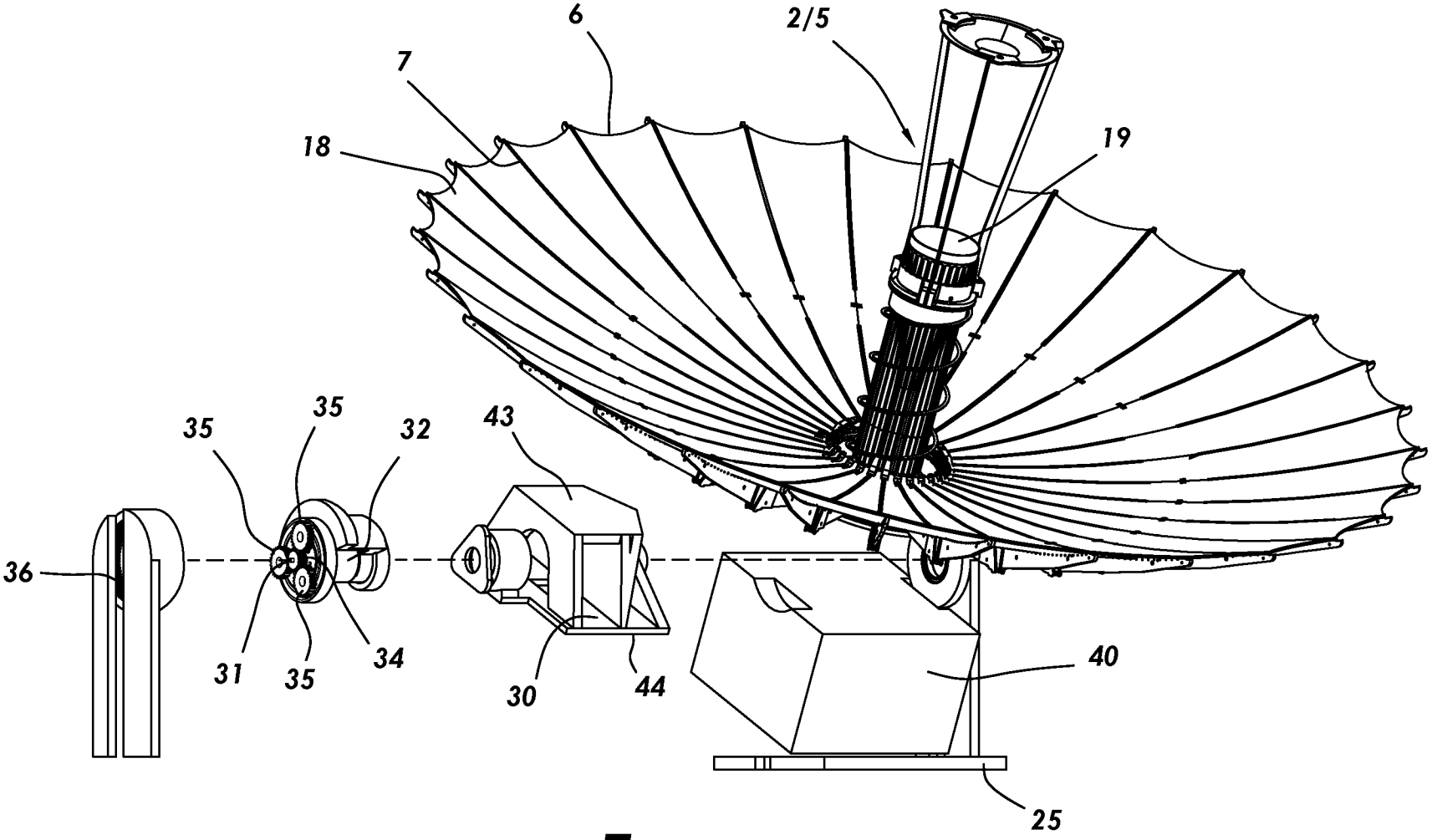

FIG. 16B is an exploded view of the first gimbal shown in FIG. 16A.

Figure 17A:
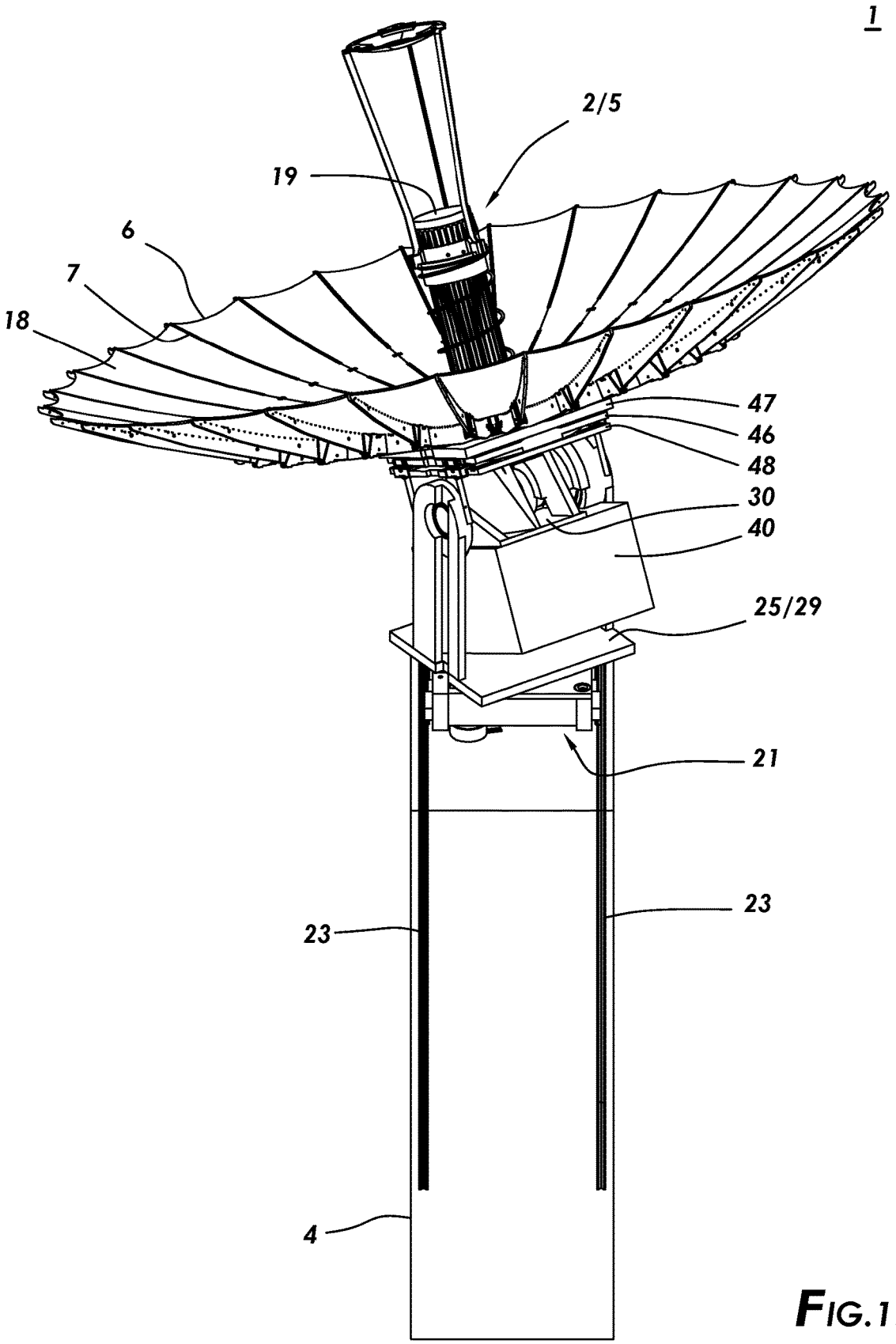

FIG. 17A is an enlarged perspective view of a particular embodiment of a second gimbal of the instant satellite, whereby the container is illustrated as transparent to allow viewing of the contained components.

Figure 17B:
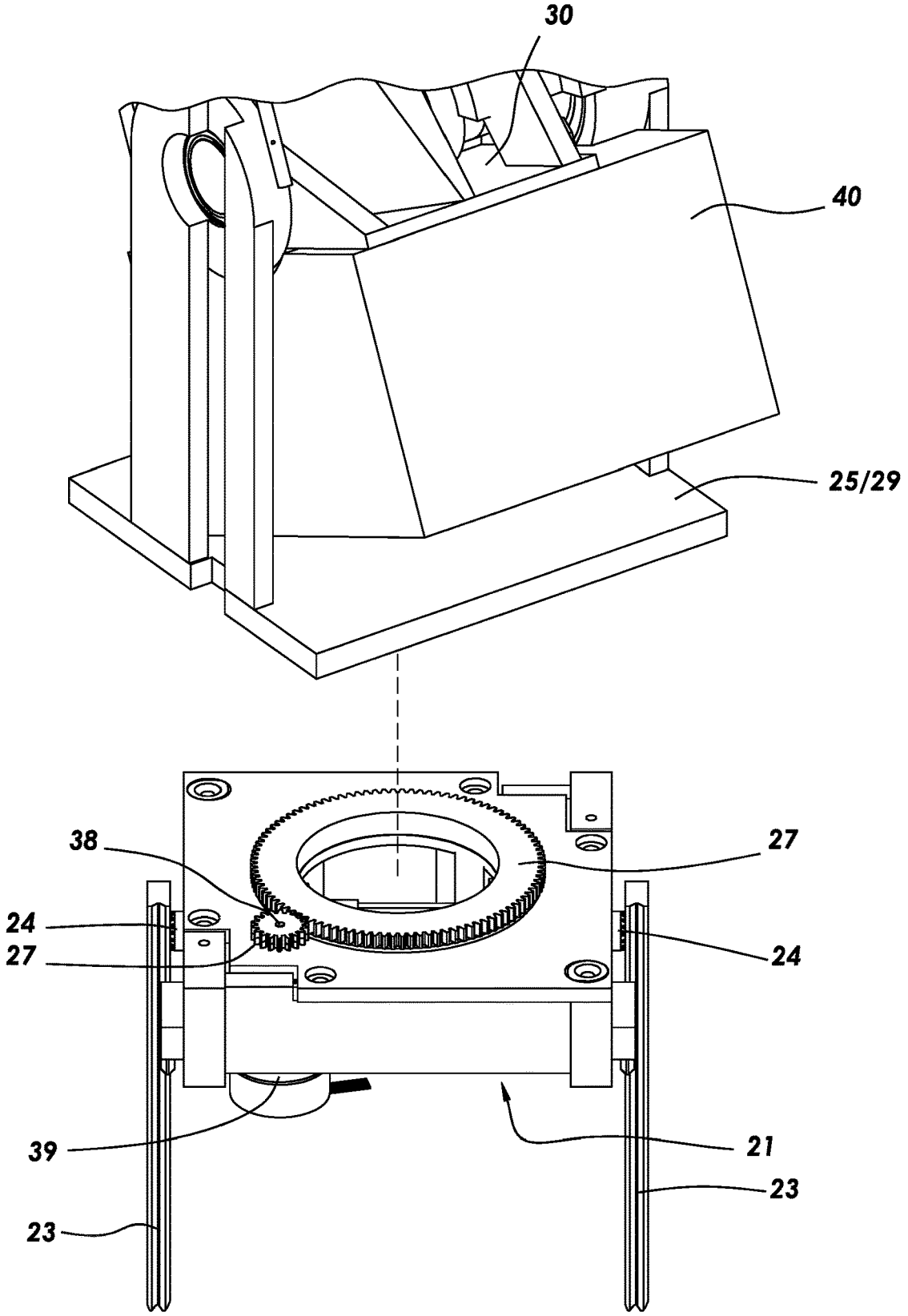

FIG. 17B is an exploded view of the second gimbal shown in FIG. 17A.

Figure 18:
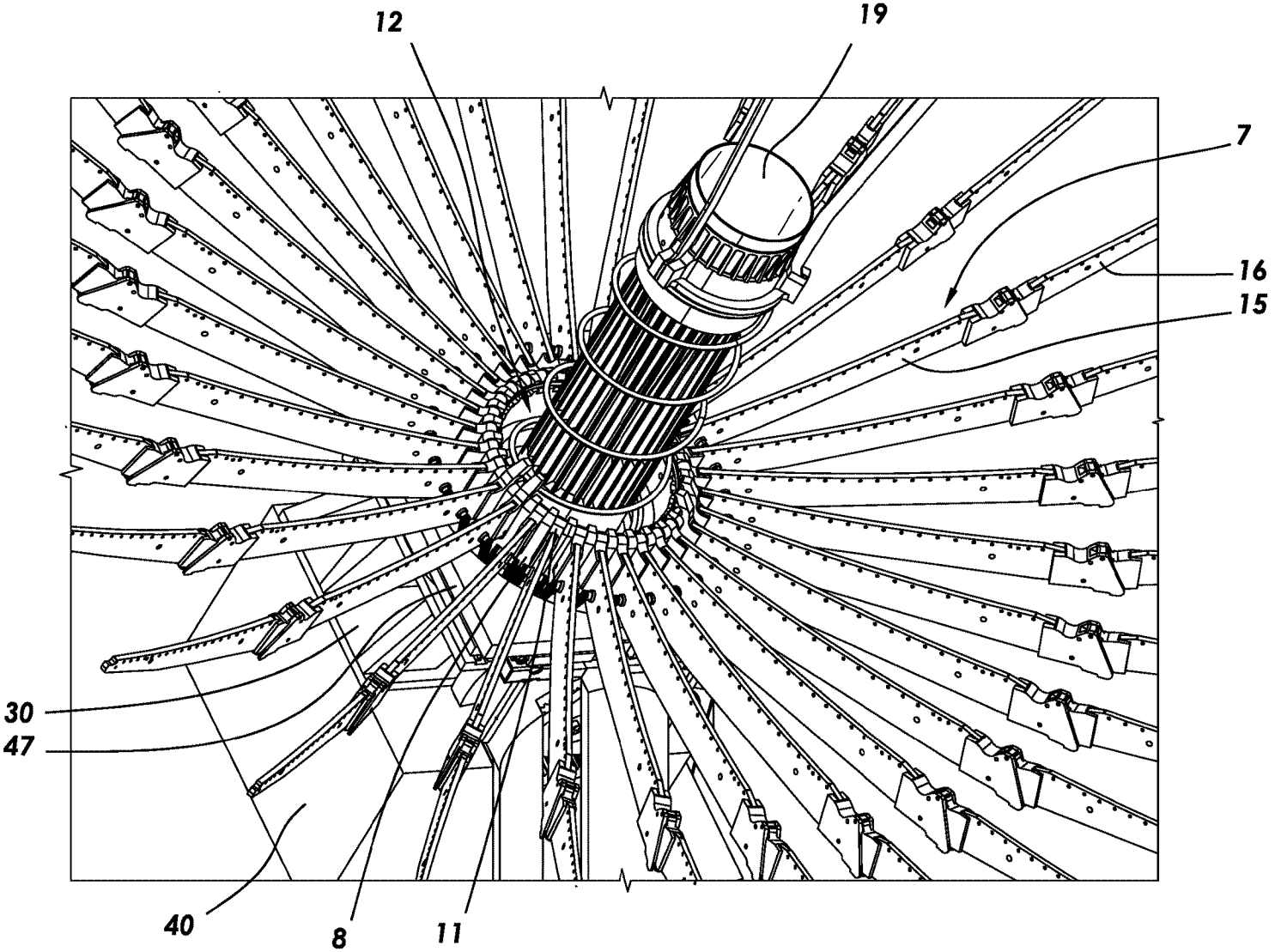

FIG. 18 is an enlarged top perspective view of an embodiment of the instant satellite including an antenna assembly, whereby the antenna assembly is disposed in a deployed configuration.

DETAILED DESCRIPTION

Now referring primarily to FIGS. 1 through 7 and 9 through 15, which illustrate an embodiment of a satellite (1) including an antenna assembly (2) disposable in (i) a stowed configuration (3) for stowage within a container (4) (as shown in FIGS. 1 through 7), and (ii) a deployed configuration (5) in which the antenna assembly (2) is deployed from within the container (4) and can correspondingly communicate with a remote target over a distance for applications such as radar, telecommunication, or the like. Significantly, when in the deployed configuration (5), a reflector (6) of the antenna assembly (2) can be directionally adjustable.

As used herein, the term "satellite" can mean an object intended to orbit another object. As to particular embodiments, the term "satellite" can refer to a machine intended to be launched into space to move around Earth or another celestial body.

The instant satellite (1) may be a miniaturized satellite and accordingly, relatively small. Thus, the container (4) may also be relatively small.

As to particular embodiments, the container (4) can comprise one or more cubes, whereby each cube can have dimensions of about 10 centimeters by about 10 centimeters by about 11 centimeters. As to particular embodiments, each cube can have a volume of about 1,100 cubic centimeters. As to particular embodiments, each cube can have a mass of not greater than about 1.33 kilograms.

As to particular embodiments, the instant satellite (1) can comprise a CubeSat (U-class spacecraft), the "CubeSat" designation meaning a small satellite which conforms to specific criteria that control factors such as its shape, size, and weight, whereby the standardized dimensions allow efficient stacking and launching of the CubeSat into space. Additional information regarding CubeSats can be found in CubeSat101 published by the National Aeronautics and Space Administration (NASA), Revision Dated October 2017, which is hereby incorporated by reference herein in its entirety.

As to particular embodiments, the instant satellite (1) can comprise a 3U CubeSat, whereby the container (4) can be configured as three cubes arranged to have dimensions of about 10 centimeters by about 10 centimeters by about 34 centimeters.

To comply with the CubeSat design requirements, the stowed configuration (3) of the antenna assembly (2) must fit within a confined space. Accordingly, the antenna assembly (2) can include a reflector (6) comprising an annular array of spaced-apart ribs (7) coupled to a hub (8), whereby the ribs (7) can be adjustable between a collapsed configuration (9) and an extended configuration (10) which enables employment of the reflector (6) for communication.

Now referring primarily to FIG. 18, the ribs (7) can be pivotally coupled to the hub (8), for example via rib first ends (11), whereby this pivotal connection can facilitate adjustment of the ribs (7) between the collapsed and extended configurations (9)(10). An opening (12) can be defined by the hub (8), whereby the ribs (7) can be pivotally coupled to the hub (8) to dispose about the opening (12).

A hub axis (13) can pass through the central opening of the hub (8), whereby this axis (13) can provide a directional frame of reference for use herein. Following, the term "axial" can mean in a direction of, on, or along the hub axis (13).

Now referring primarily to FIGS. 1 through 7, in the collapsed configuration (9), the ribs (7) can pivot relative to the hub (8) to dispose the ribs (7) in generally parallel relation to the hub axis (13). Consequently, the stowed configuration (3) of the antenna assembly (2) can have a generally cylindrical shape, which may allow accommodation of the antenna assembly (2) within the container (4).

Now referring primarily to FIGS. 9 through 15, to achieve the extended configuration (10) from the collapsed configuration (9), the ribs (7) can pivot away from the hub axis (13) to outwardly extend from the hub (8).

Now referring primarily to FIGS. 1 through 7, as to particular embodiments, in addition to the collapsed configuration (9), the ribs (7) can further be compacted into a furled (or folded) configuration (14) to facilitate stowage of the antenna assembly (2) within the container (4). As to these embodiments, each rib (7) can include a rib inner portion (15) pivotally coupled to a rib outer portion (16) at a pivot point, whereby in the furled configuration (14), the rib inner and outer portions (15)(16) can dispose in side-by-side radial relation. Said another way, the rib inner and outer portions (15)(16) can be folded together to provide the furled configuration (14).

Now referring primarily to FIGS. 9 through 15, unfurling the ribs (7) results in an unfurled (or unfolded) configuration (17) which permits employment of the reflector (6) for communication. In the unfurled configuration (17), the rib inner and outer portions (15)(16) can dispose in end-to-end radial relation to, in combination with the extended configuration (10) of the ribs (7), achieve the deployed configuration (5) of the antenna assembly (2).

Again referring primarily to FIGS. 9 through 15, the reflector (6) can further include a reflective material (18) coupled to the ribs (7), whereby the reflective material (18) can facilitate communication with a remote target. As but one illustrative example, the reflective material (18) can comprise mesh.

Now referring primarily to FIGS. 1 through 8, the satellite (1) can further include a deployer (21) configured to deploy the antenna assembly (2) from within the container (4) to dispose the reflector (6) in spaced-apart relation to the container (4).

As to particular embodiments, the deployer (21) can axially deploy the antenna assembly (2) from within the container (4). As to these embodiments, the deployer (21) can include a linear actuator, such as a rack and pinion assembly (22). The rack (23), which may be configured as a toothed elongate member, can be fixedly coupled to the container (4) and the pinion (24) can be coupled to a plate (25) which supports the antenna assembly (2).

Figure 1:
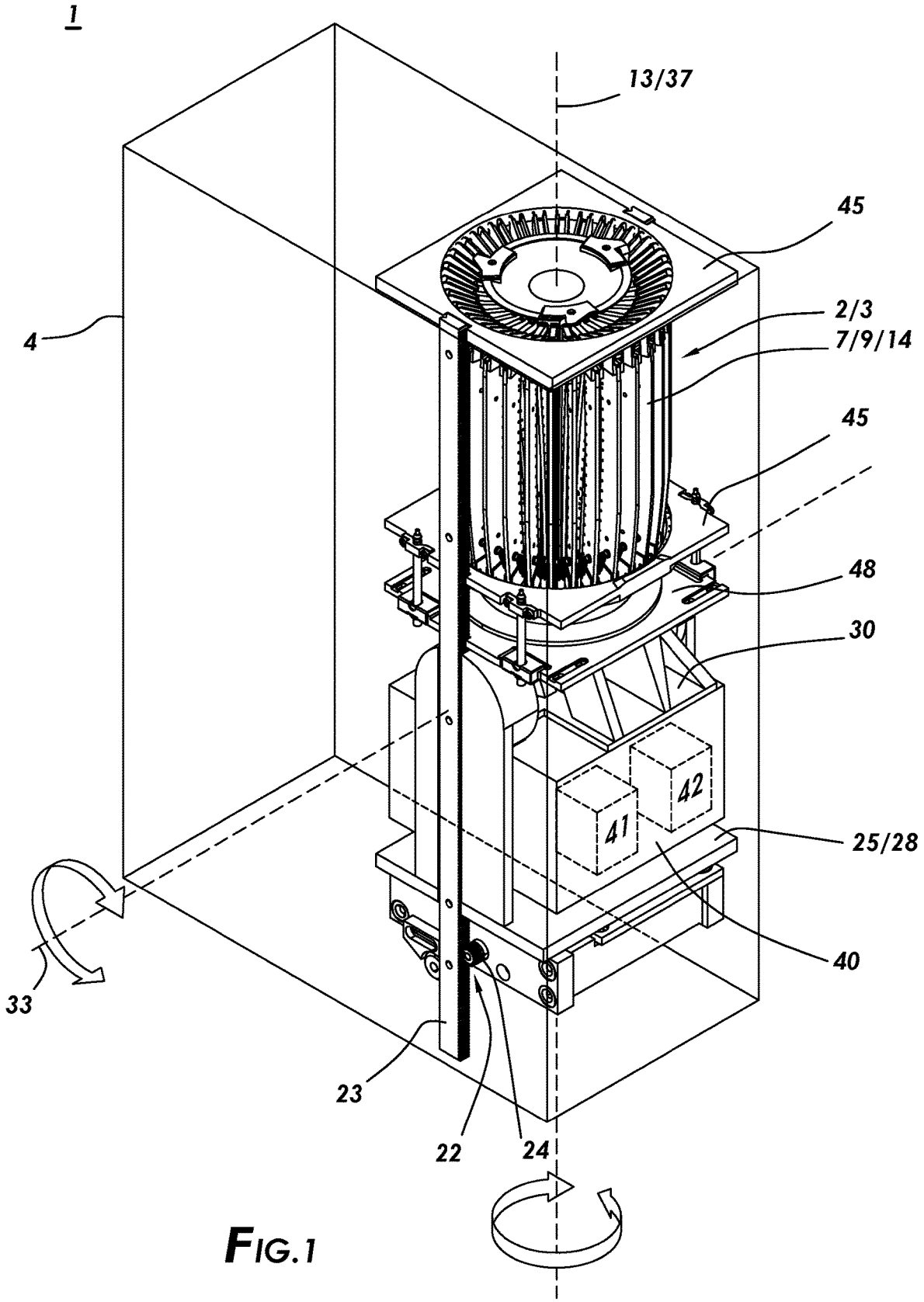
FIG. 1 is a perspective view of an embodiment of the instant satellite including an antenna assembly, whereby the antenna assembly is disposed in a stowed configuration for stowage within a container.
Figure 3:
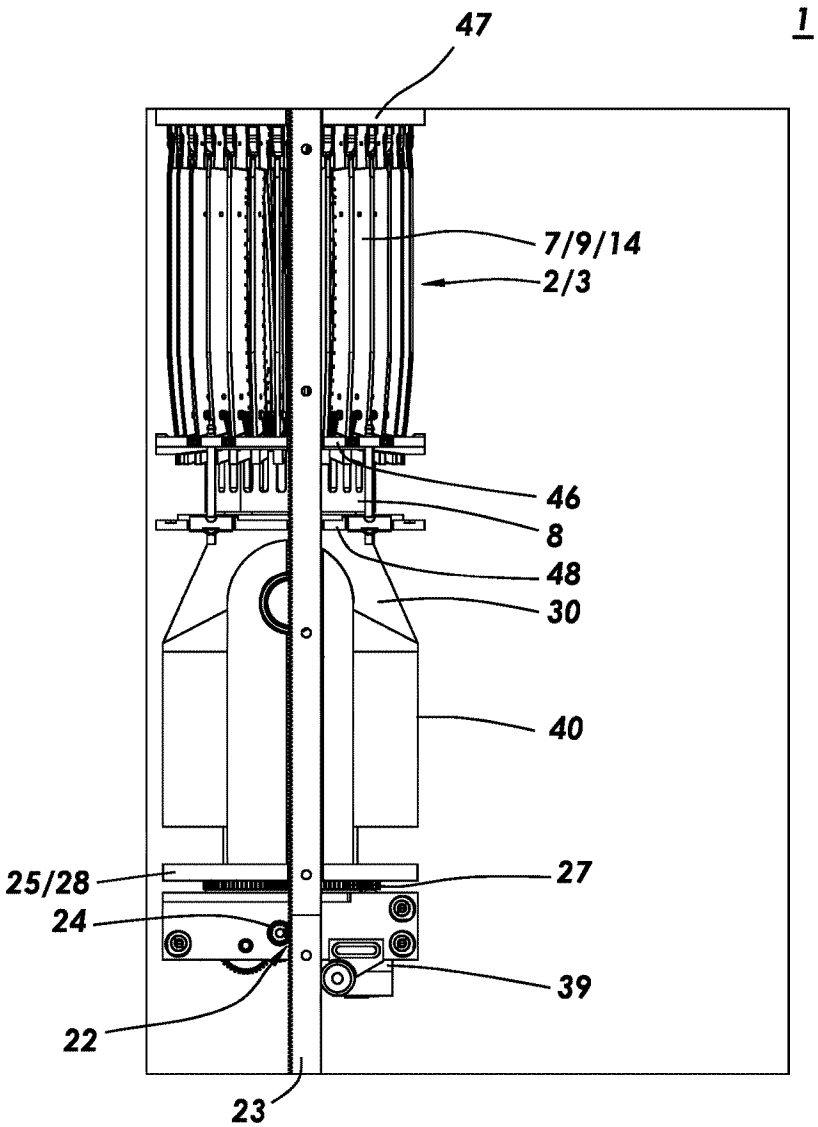
FIG. 3 is a rear view of the particular embodiment of the satellite shown in FIG. 1.
Figure 2:
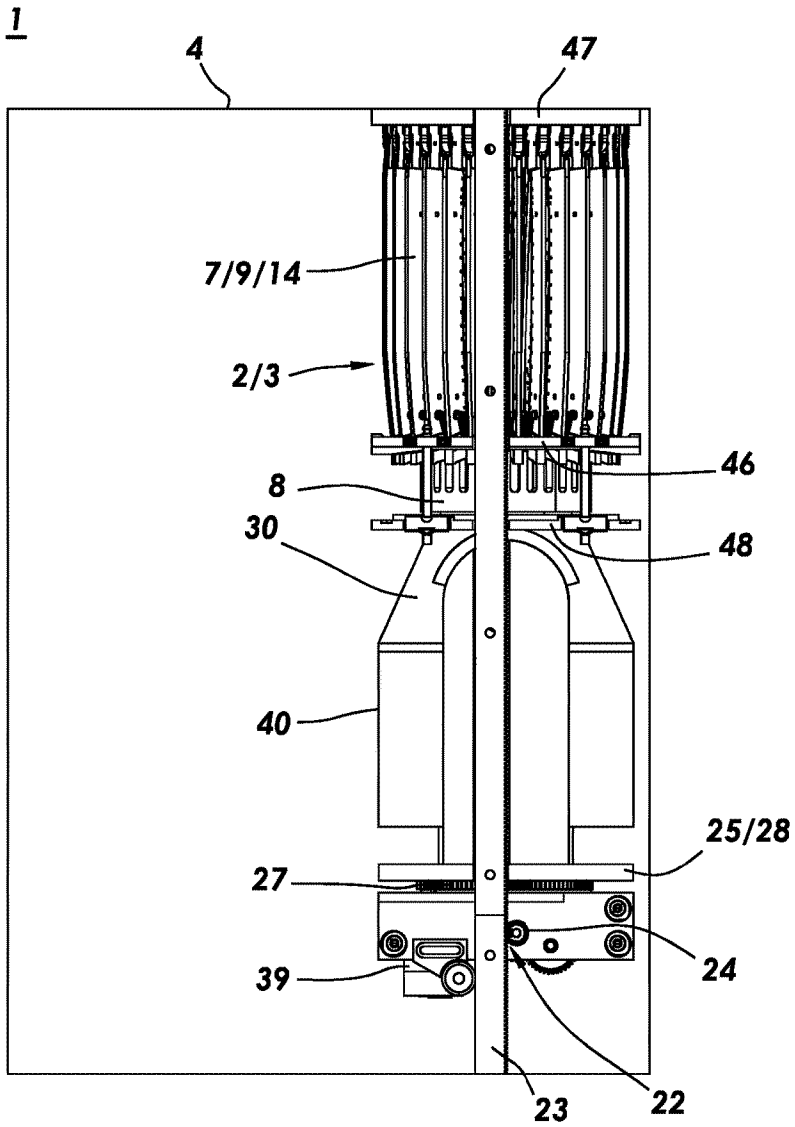
FIG. 2 is a front view of the particular embodiment of the satellite shown in FIG. 1.
Figure 5:
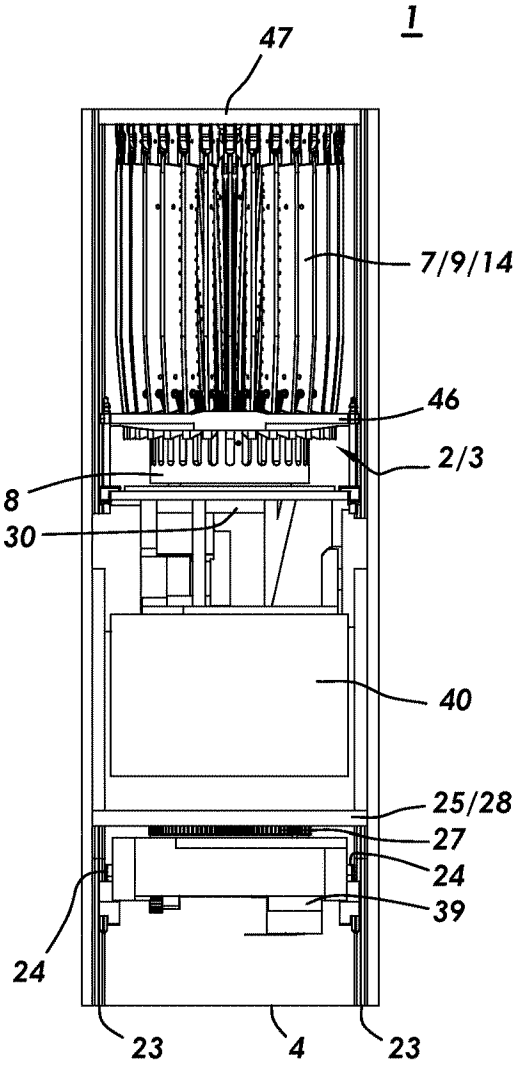
FIG. 5 is a second side view of the particular embodiment of the satellite shown in Figure
Figure 6:
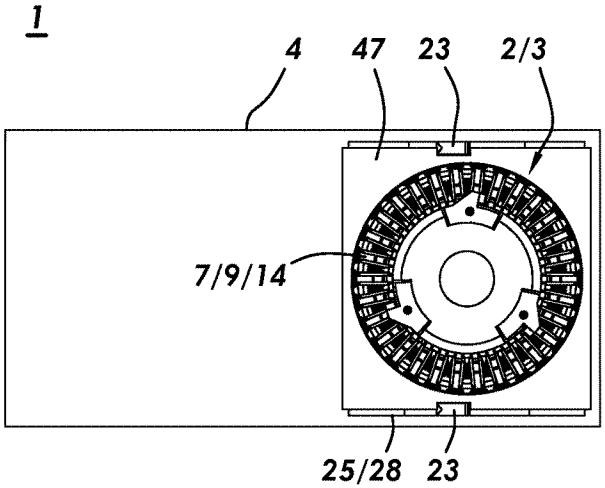
FIG. 6 is a top view of the particular embodiment of the satellite shown in FIG. 1.
Figure 7:
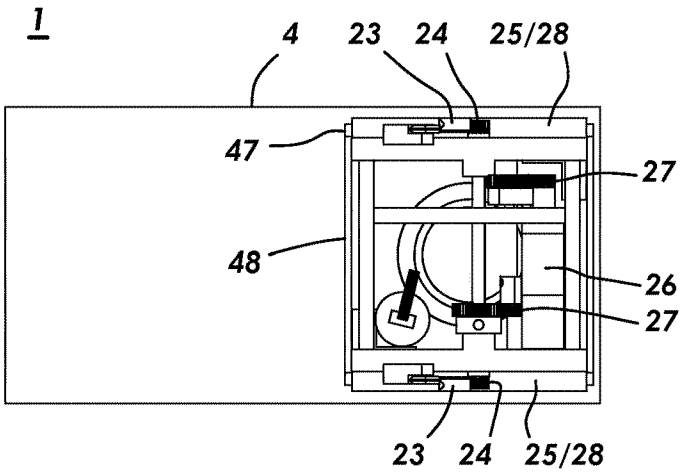
FIG. 7 is a bottom view of the particular embodiment of the satellite shown in FIG. 1.
Figure 4:
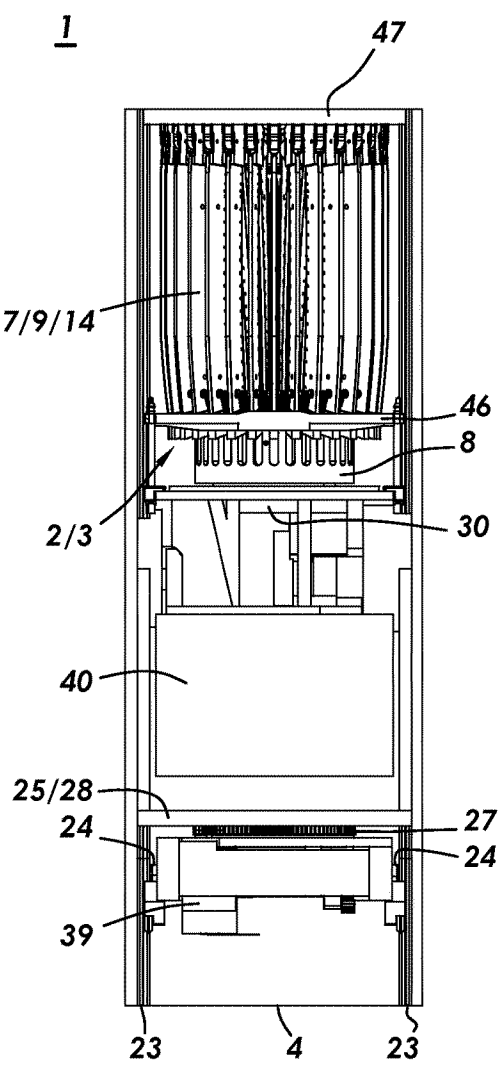
FIG. 4 is a first side view of the particular embodiment of the satellite shown in FIG.
Figure 8:
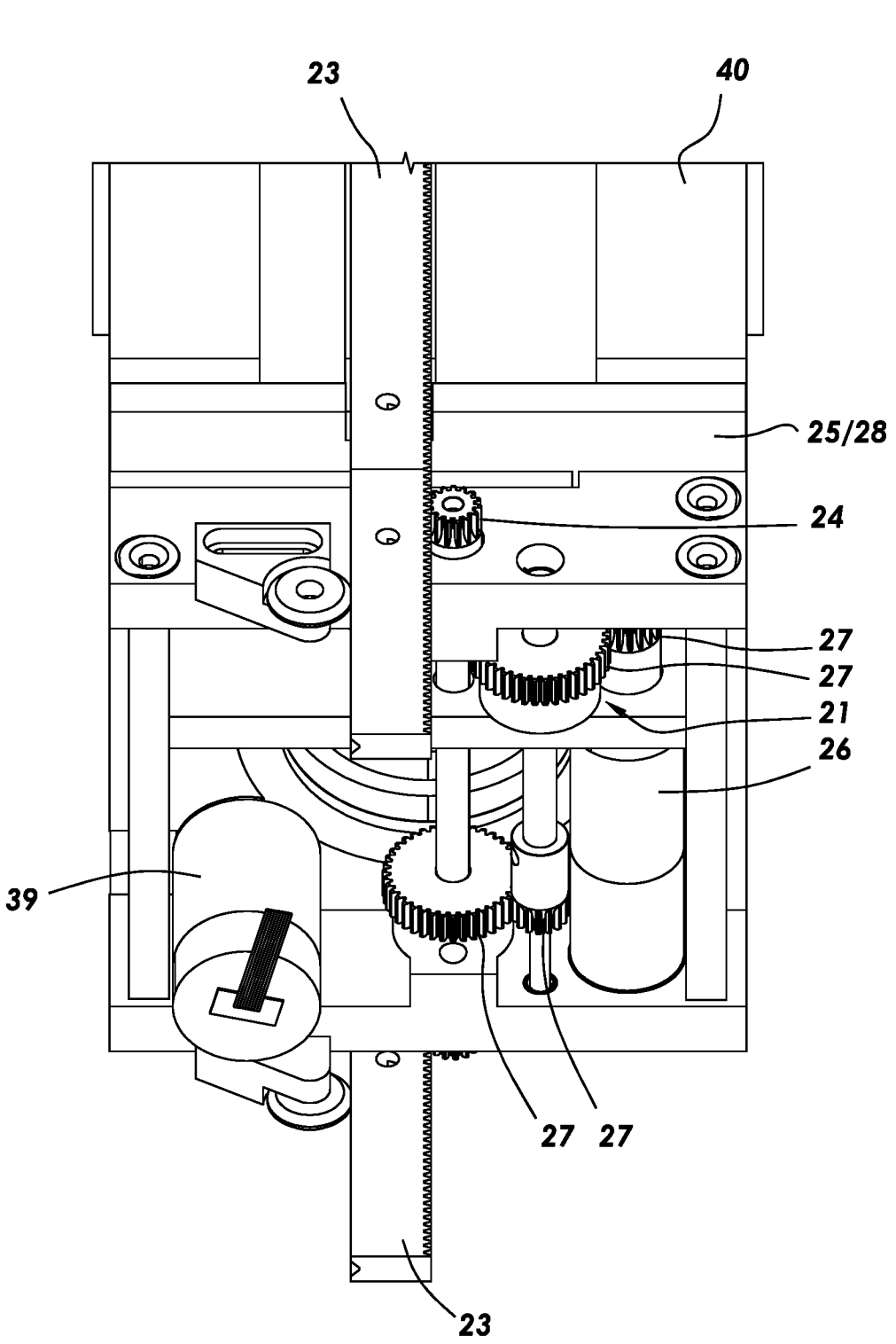
FIG. 8 is bottom perspective view of a deployer of the instant satellite.

Now referring primarily to FIG. 8, rotation of the pinion (24) can be actuated by a deployer motor (26) operatively coupled to the pinion (24). As to particular embodiments, the deployer motor (26) can be coupled to the pinion (24) by one or more gears (27), whereby rotation of the pinion (24) via the deployer motor (26) and gears (27) drives linear movement of the plate (25) along the rack (23) to axially deploy the antenna assembly (2) from within the container (4).

As to particular embodiments, at least two rack and pinion assemblies (22) may be employed to axially deploy the antenna assembly (2) from within the container (4). For example, two racks (23) can be disposed within the container (4) in opposing, substantially parallel relation, with the plate (25) therebetween. Upon actuation of the pinion (24), the plate (25) can be driven from a first position (28) within the container (4) (as shown in the examples of FIGS. 1 through 7) toward a second position (29) outside of the container (4) (as shown in the examples of FIGS. 9 through 15). In the second position (29), the plate (25) can be (i) disengaged from the rack(s) (23) and (ii) disposed in spaced-apart relation to the container (4).

Importantly, upon deployment, the reflector (6) can dispose in spaced-apart relation to the container (4), thereby permitting unimpeded directional adjustment of the reflector (6) to point the reflector (6) toward a remote target. Said another way, once deployed, the reflector (6) can be located a sufficient distance from the container (4) to allow the directional adjustment disclosed herein.

As to particular embodiments, when the antenna assembly (2) disposes in the deployed configuration (5), the reflector (6) can be spaced apart from the container (4) a distance of at least half of its diameter. As but one illustrative example, when the antenna assembly (2) disposes in the deployed configuration (5), a reflector (6) having a diameter of about 50 centimeters can be spaced apart from the container (4) by a distance of at least about 25 centimeters.

Now referring primarily to FIGS. 16A and 16B, the reflector (6) can be adjustable in elevation. Correspondingly, the satellite (1) can include a pivotable support such as a first gimbal (30) fixedly coupled to the reflector (6) to facilitate pivotal movement of the reflector (6) relative to the plate (25). The first gimbal (30) can be operatively coupled to a rotatable first shaft (31), whereby rotation of the first shaft (31), for example by a first motor (32), can drive the first gimbal (30) to pivot about a first axis (33), correspondingly pivoting the reflector (6) about the first axis (33) to adjust the elevation of the reflector (6).

Now referring primarily to FIG. 16B, the first shaft (31) can be operatively coupled to the first gimbal (30) by one or more gears. As to particular embodiments, the first shaft (31) can be operatively coupled to the first gimbal (30) by a gear system. As but one illustrative example, the gear system can comprise a sun-and-planet gear system including a sun gear (34) which drives a plurality of planet gears (35), whereby the planet gears (35) can be operatively coupled to an internal gear (36) fixedly coupled to the plate (25). Accordingly, rotation of the first shaft (31) can drive rotation of the sun gear (34), rotation of the sun gear (34) can drive rotation of the planet gears (35), and rotation of the planetary gears (35) within the internal gear (36) can drive pivotal movement of the first gimbal (30) and the reflector (6) in relation to the plate (25) to adjust the elevation of the reflector (6).

As to particular embodiments, the reflector (6) can be adjustable in elevation by up to at least about ±90 degrees from its centered or 0° position.

Now referring primarily to FIGS. 17A and 17B, the reflector (6) can be adjustable in azimuth. Accordingly, the satellite (1) can include a rotatable support such as a second gimbal coupled to the reflector (6) to facilitate rotation of the reflector (6) about a second axis (37). As to particular embodiments such as those shown in the Figures, the second gimbal can be provided by the plate (25).

Now referring primarily to FIG. 17B, the second gimbal (25) can be operatively coupled to a rotatable second shaft (38), whereby rotation of the second shaft (38), for example by a second motor (39), can drive the second gimbal (25) to rotate about the second axis (37), correspondingly rotating the reflector (6) about the second axis (37) to adjust the azimuth of the reflector (6). As to particular embodiments, the second shaft (38) can be operably coupled to the second gimbal (25) by one or more gears (27).

As to particular embodiments, the reflector (6) can be adjustable in azimuth by up to at least about ±360 degrees from its centered or 0° position.

As to particular embodiments, the reflector (6) can be adjustable in azimuth by up to at least about ±400 degrees from its centered or 0° position.

As to particular embodiments, the satellite (1) can further include a housing (40) configured to contain one or more controllers (41) and the associated circuitry to control (i) deployment of the antenna assembly (2), for example to control movement of the plate (25), and (ii) directional adjustment of the reflector (6), for example to control pivotal movement of the first gimbal (30) to adjust the elevation of the reflector (6) and to control rotation of the second gimbal (25) to adjust the azimuth of the reflector (6). Additionally, the controller (41) can facilitate communication between the instant satellite (1) and a remote target, thus controlling a receiver, a transmitter, a radio, a transceiver (42)), or the like.

Now referring primarily to FIGS. 10 through 13, the housing (40) can be directly coupled to the antenna assembly (2) to dispose the transceiver (42)) in close spatial relation to the antenna assembly (2). As to particular embodiments, the antenna assembly (2) can be coupled, directly coupled, connected, or directly connected to a first face (43) of the first gimbal (30) and the housing (40) can be coupled, directly coupled, connected, or directly connected to an opposing second face (44) of the first gimbal (30) to dispose the transceiver (42)) in close spatial relation to the antenna assembly (2). As to this particular embodiment, the housing (40) can pivot along with the antenna assembly (2) about the first axis (33) upon pivotal movement of the first gimbal (30).

Such a location of the housing (40) and transceiver (42)) relative to the antenna assembly (2) may be beneficial in that it can provide a relatively short transmission path between the reflector (6) and the transceiver (42)), thereby minimizing radio frequency loss. As to particular embodiments, the transmission path can be directly through the waveguide and consequently, not via a coaxial cable. Additionally, in such a configuration, the housing (40) can function as a counterbalance for the antenna assembly (2) when pivoting about the first axis (33), accordingly lowering inertia. Moreover, such a location of the housing (40) and transceiver (42)) relative to the antenna assembly (2) can allow the antenna assembly (2) to function as a heat sink for the controller (41) and associated circuitry.

Now referring primarily to FIGS. 2 through 5, as to particular embodiments, the ribs (7) can be biased toward the extended configuration (10) as well as the unfurled configuration (17), for example by springs. Correspondingly, the satellite (1) can further include at least one retainer (45) disposed about the ribs (7) in the collapsed and furled configurations (9)(14) to retain the ribs (7) in such configurations and enable the stowed configuration (3) of the antenna assembly (2). Moreover, the retainer (45) can also act to guide the ribs (7) for axial deployment of the antenna assembly (2) from within the container (4).

As to particular embodiments, a plurality of retainers (45) can be disposed about the ribs (7) in the collapsed and furled configurations (9)(14); for example, the satellite (1) can include first and second retainers (46)(47) disposed in axially spaced-apart relation, whereby the first retainer (46) can dispose proximate the hub (8) and the rib first ends (11), and the second retainer (47) can dispose proximate the pivot point between the rib inner and outer portions (15)(16).

To permit adjustment of the ribs (7) from the collapsed configuration (9) to the extended configuration (10) and from the furled configuration (14) to the unfurled configuration (17), each retainer (45) can be movable in relation to the hub (8) and, as to particular embodiments, in relation to a base plate (48) to which the hub (8) is coupled or connected. As to particular embodiments, each retainer (45) can be slidably engaged with the base plate (48), therefore enabling sliding of the retainer (45) in relation to the base plate (48). Upon sliding of the retainer (45) toward the base plate (48), for example during axial deployment of the antenna assembly (2) from within the housing (4), the ribs (7) can be liberated, thus allowing the ribs (7) to pivot from the collapsed configuration (9) to the extended configuration (10) and from the furled configuration (14) to the unfurled configuration (17). As to particular embodiments, each retainer (45) can slide to a position adjacent to the base plate (48) for stacking upon the base plate (48).

As to particular embodiments, the retainer (45) can, but need not necessarily, be configured as a plate having an aperture centrally extending therethrough, whereby the ribs (7) in the collapsed and furled configurations (9)(14) can be located within the aperture to circumferentially dispose the plate about the ribs (7).

It is herein noted that components of the antenna assembly (2) can be in fixed relation to one another and correspondingly, can move as one unit. For example, the horn (19) can be in fixed relation to the reflector (6). Thus, pivotal movement of the first gimbal (30) can pivot at least the horn (19) and the reflector (6) about the first axis (33) as one unit to adjust the elevation thereof.

Now regarding production, a method of making the instant satellite (1) can include coupling an antenna assembly (2) to a deployer (21), whereby the deployer (21) can be configured to deploy the antenna assembly (2) from a container (4).

As to particular embodiments, the method can further include coupling a first gimbal (30) to the antenna assembly (2), whereby the first gimbal (30) can be configured to adjust the elevation of the antenna assembly (2) when the antenna assembly (2) is deployed from within the container (4).

As to particular embodiments, the method can further include coupling a second gimbal (25) to the antenna assembly (2), whereby the second gimbal (25) can be configured to adjust the azimuth of the antenna assembly (2) when the antenna assembly (2) is deployed from within the container (4).

The method of making the satellite (1) can further include providing additional components of the satellite (1), as described above and in the claims.

Now regarding employment, a method of using the instant satellite (1) can include launching the satellite (1) into space, for example as part of a NASA's CubeSat Launch Initiative (CSLI).

The method can further include deploying the antenna assembly (2) from within the container (4), such as by operating the deployer (21) to axially deploy the antenna assembly (2) from within the container (4).

The method can further include adjusting a direction of the antenna assembly.

As to particular embodiments, the method can further include adjusting the elevation of the antenna assembly (2), for example by operating the first gimbal (30).

As to particular embodiments, the method can further include adjusting the azimuth of the antenna assembly (2), for example by operating the second gimbal (25).

As to particular embodiments, the method can further include adjusting both the elevation and the azimuth of the antenna assembly (2).

As to particular embodiments, the method can further include operating the antenna assembly (2) to communicate with a remote target.

As can be easily understood from the foregoing, the basic concepts of the present invention may be embodied in a variety of ways. The invention involves numerous and varied embodiments of a satellite and methods for making and using such a satellite.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or a method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupler" and even a "means for coupling." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in Merriam-Webster's Dictionary, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about", it will be understood that the particular value forms another embodiment. The term "about" generally refers to a range of numeric values that one of skill in the art would consider equivalent to the recited numeric value or having the same function or result. Similarly, the antecedent "substantially" or "generally" means largely, but not wholly, the same form, manner or degree and the particular element will have a range of configurations as a person of ordinary skill in the art would consider as having the same function or result. When a particular element is expressed as an approximation by use of the antecedent "substantially" or "generally", it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Thus, the applicant should be understood to claim at least: (i) each embodiment of the satellite herein disclosed and described, (ii) the related methods disclosed and described, (iii) similar, equivalent, and even implicit variations of each of these apparatuses and methods, (iv) those alternative embodiments which accomplish each of the functions shown, disclosed, or described, (v) those alternative designs and methods which accomplish each of the functions shown as are implicit to accomplish that which is disclosed and described, (vi) each feature, component, and step shown as separate and independent inventions, (vii) the applications enhanced by the various systems or components disclosed, (viii) the resulting products produced by such systems or components, (ix) methods and apparatuses substantially as described hereinbefore and with reference to any of the accompanying examples, and (x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of embodiments of the invention and are not to be construed as the broadest embodiment of the invention or a complete listing of embodiments of the invention that may be claimed. The applicant does not waive any right to develop further claims based upon the description set forth above or in the drawings as a part of any continuation, division, continuation-in-part, or similar application.

The invention claimed is:

1. A satellite, comprising:

an antenna assembly adjustable between a stowed configuration and a deployed configuration, said antenna assembly comprising:

a reflector comprising an annular array of spaced-apart ribs coupled to a hub, said ribs adjustable between a collapsed configuration and an extended configuration in which said ribs outwardly extend from said hub;

wherein when said ribs dispose in said collapsed configuration, said antenna assembly is disposable in said stowed configuration for stowage within a container; and wherein when said antenna assembly disposes in said deployed configuration:

(i) said ribs dispose in said extended configuration; and (ii) said reflector is directionally adjustable;

said reflector coupled to a first gimbal, said first gimbal configured to facilitate directional adjustment of said reflector about a first axis; and a transceiver contained within a housing, said transceiver operable to communicate with a remote target;

said housing coupled to said first gimbal such that said housing pivots along with said reflector about said first axis upon pivotal movement of said first gimbal.

2. The satellite of claim 1, said container configured as one or more cubes.

3. The satellite of claim 2, each said cube having dimensions of about 10 centimeters by about 10 centimeters by about 11 centimeters.

4. The satellite of claim 3, said container compatible with standardized dimensions of a CubeSat.

5. The satellite of claim 1, further comprising a deployer coupled to said antenna assembly, said deployer configured to deploy said antenna assembly from within said container.

6. The satellite of claim 5, wherein said deployer axially deploys said antenna assembly from within said container.

7. The satellite of claim 6, wherein said deployer comprises a linear actuator.

8. The satellite of claim 1, said reflector adjustable in elevation.

9. The satellite of claim 8, said first gimbal configured to facilitate adjustment of said elevation.

10. The satellite of claim 8, said reflector adjustable in elevation by up to at least about ±90 degrees.

11. The satellite of claim 1, said reflector adjustable in azimuth.

12. The satellite of claim 11, said reflector coupled to a second gimbal, said second gimbal configured to facilitate adjustment of said azimuth.

13. The satellite of claim 11, said reflector adjustable in azimuth by up to at least about ±360 degrees.

14. The satellite of claim 1, said reflector adjustable in elevation and azimuth.

15. The satellite of claim 1, said housing coupled to said first gimbal opposite said antenna assembly.

16. A satellite, comprising:

an antenna assembly adjustable between a stowed configuration and a deployed configuration, said antenna assembly comprising:

a reflector comprising an annular array of spaced-apart ribs coupled to a hub, said ribs adjustable between a collapsed configuration and an extended configuration in which said ribs outwardly extend from said hub;

wherein when said ribs dispose in said collapsed configuration, said antenna assembly is disposable in said stowed configuration for stowage; and wherein when said antenna assembly disposes in said deployed configuration:

(i) said ribs dispose in said extended configuration; and (ii) said reflector is directionally adjustable;

said reflector coupled to a first gimbal, said first gimbal configured to facilitate directional adjustment of said reflector about a first axis; and a transceiver operable to communicate with a remote target, said transceiver coupled to said first gimbal such that said transceiver pivots along with said reflector about said first axis upon pivotal movement of said first gimbal.

17. The satellite of claim 16, said reflector adjustable in elevation by said first gimbal.

18. The satellite of claim 16, said reflector adjustable in azimuth by a second gimbal coupled to said antenna assembly.

19. The satellite of claim 16, said reflector adjustable in (i) elevation by said first gimbal and (ii) azimuth by a second gimbal coupled to said antenna assembly.

20. A satellite, comprising:

an antenna assembly adjustable between a stowed configuration and a deployed configuration, said antenna assembly comprising:

a reflector comprising an annular array of spaced-apart ribs coupled to a hub, said ribs adjustable between a collapsed configuration and an extended configuration in which said ribs outwardly extend from said hub;

wherein when said ribs dispose in said collapsed configuration, said antenna assembly is disposable in said stowed configuration for stowage; and wherein when said antenna assembly disposes in said deployed configuration:

(i) said ribs dispose in said extended configuration; and (ii) said reflector is directionally adjustable;

said reflector coupled to a first gimbal, said first gimbal configured to facilitate directional adjustment of said reflector about a first axis; and a transceiver operable to communicate with a remote target, said transceiver coupled to said first gimbal such that said transceiver pivots along with said reflector about said first axis upon pivotal movement of said first gimbal;

said transceiver disposed in axial alignment with said hub.

* * * * *